US005588540A

United States Patent [19]

Schmit

[11] Patent Number: 5,588,540

[45] **Date of Patent: *Dec. 31, 1996**

[54] MODULAR STORAGE UNIT KIT

[76] Inventor: Joel A. Schmit, 1916 NW. 86th Cir., Vancouver, Wash. 98665

[ * ] Notice: The term of this patent shall not extend beyond the expiration date of Pat. No. 5,495,954.

[21] Appl. No.: 610,996

[22] Filed: Mar. 5, 1996

Related U.S. Application Data

[63] Continuation of Ser. No. 243,846, May 16, 1994, Pat. No. 5,495,954.

[51] Int. Cl.[6] ..... A47F 5/00

[52] U.S. Cl. ..... 211/90; 211/94; 211/187; 312/246

[58] Field of Search ..... 211/90, 191, 94, 211/87, 187, 189, 186; 312/223.6, 246, 351.3

[56] References Cited

U.S. PATENT DOCUMENTS

| | | | |
|---|---|---|---|
| 3,042,978 | 7/1962 | Eames et al. | 211/87 X |
| 3,212,646 | 10/1965 | Propst | 211/87 |
| 3,317,261 | 5/1967 | Peterson et al. | 312/246 X |
| 4,180,298 | 12/1979 | Borgerson | 312/242 |
| 4,545,490 | 10/1985 | Hsiao et al. | 211/191 |
| 4,549,665 | 10/1985 | Switley | 211/191 |
| 4,928,833 | 5/1990 | Huizenga | 211/187 |
| 5,392,934 | 2/1995 | Fox | 211/94 |
| 5,495,954 | 3/1996 | Schmit | 211/90 |

OTHER PUBLICATIONS

Pamphlet entitled Stanley Steel Plank Storage System by Stanley Hardware dated 1993.

Pamphlet entitled Spur by Schulte dated 1993 Schulte Corporation.

Pamphlet entitled Storage Systems From Lee/Rowan dated 1992 Lee/Rowan Company.

Pamphlet entitled Storage Pride by Mill's Pride Pamphlet Obtained from Home Depot #4705, 6810S. 180th St. Tukwila, WA 98188.

Pamphlet entitled Storage Pride 24 "Deep Closet Starter "by Mill's Pride Obtained from Home Depot #4002, 14800 S. W. Sequola Pkwy., Tigard, OR 97223 Flyer entitled Rigid–Tie Corner Connector by Simpson Strong–Tie Company, Inc., 1992.

Flyer entitled Rigid–Tie Corner Connector by Simpson Strong–Tie Company, Inc., 1992.

Flyer entitled Heavy Duty Storage Shelves by Simpson Strong–Tie Co., Inc., Jul. 1992 obtained from Home Depot #4002,14800 S. W. Sequola Pkwy; Tigard, OR 97223.

*Primary Examiner*—Robert W. Gibson, Jr.
*Attorney, Agent, or Firm*—Robert L. Harrington

[57] ABSTRACT

A modular storage unit provided in kit form that is readily assembled, is securable to a vertical wall and is arranged to be supported on a floor. Rails are mounted to the wall and the framework of the storage unit is secured to the rails. Outer legs of the framework extend to the floor and adjusters are provided to compensate for slope or other variations in the floor. The components of the storage unit have holes or slots that facilitate assembly by the use of common fasteners. The storage unit is arranged to fit around obstructions such as footings so that the storage unit may be mounted basically flush to the wall.

5 Claims, 3 Drawing Sheets

MODULAR STORAGE UNIT KIT

This is a continuation of application Ser. No. 08/243,846 filed on May 16, 1994, now U.S. Pat. No. 5,495,954.

FIELD OF THE INVENTION

This invention relates to storage unit kits for storage and more particularly relates to modular storage kits securable to a vertical wall and arranged for uniform support on an uneven floor and/or non-level surface.

BACKGROUND OF THE INVENTION

Homeowners almost always desire additional storage space. One of the places in which additional storage can be provided is in the garage. Most homes, when they are built and sold do not have storage units in the garage and it is up to the purchaser of the home to add storage units for storage. The garages generally have adequate space adjacent one or more walls for a storage unit.

The homeowners may have the storage units custom built by a craftsman, may construct the storage units themselves or purchase units to assemble and free stand on the floor or mount to a wall.

Custom made storage units are expensive and often exceed the cost that the homeowner desires to expend. The homeowner may choose to build or construct their own units but building storage units often is difficult particularly if the homeowner either lacks in the skill or does not have the proper tools at her/his disposal.

Ready made storage units that are purchased and assembled rarely are a satisfactory solution. Most garage floors are uneven and have a slight slope toward the vehicle doorway. Additionally most garage walls are supported on a footing that extends upward from the floor and inward beyond the inner surface of the garage wall. Ready made storage units will then not be plumb, will not be seated against a wall and most often are not rigidly secured in position.

There is a need for storage unit kit that can be purchased and easily assembled by the novice home owner to provide a level storage unit that conforms to the uneven supporting floor, e.g., a garage and is rigidly attached to a vertical wall.

BRIEF SUMMARY OF THE INVENTION

A preferred embodiment of the present invention is a storage unit kit with components that are easily assembled into a storage unit that will accommodate variances in the supporting floor and is securely attached to a vertical wall. The storage unit is modular in design, requires minimum skill to assemble and secure in place. Further only common hand tools are needed to complete the assembly.

The components of the storage unit are arranged for ready attachment one to another. The components have holes and/or slots provided at strategic locations to facilitate the assembly by utilizing common conventional fasteners such as screws, nuts and bolts, and the like.

The framework of the storage unit includes horizontal support rails attached to a vertical wall at determined heights. The rails are mounted level and parallel to each other with one being mounted at a distance above the other. The balance of the framework of the storage unit is attached to the horizontal rails with the framework being additionally supported on the floor. Adjustable floor supports or adjusters are provided to compensate for any variance in the floor surface. The storage unit is further arranged to accommodate an obstruction, such as a footing, that may extend beyond the surface of the wall.

DESCRIPTION OF THE PREFERRED EMBODIMENT

Figure 1:
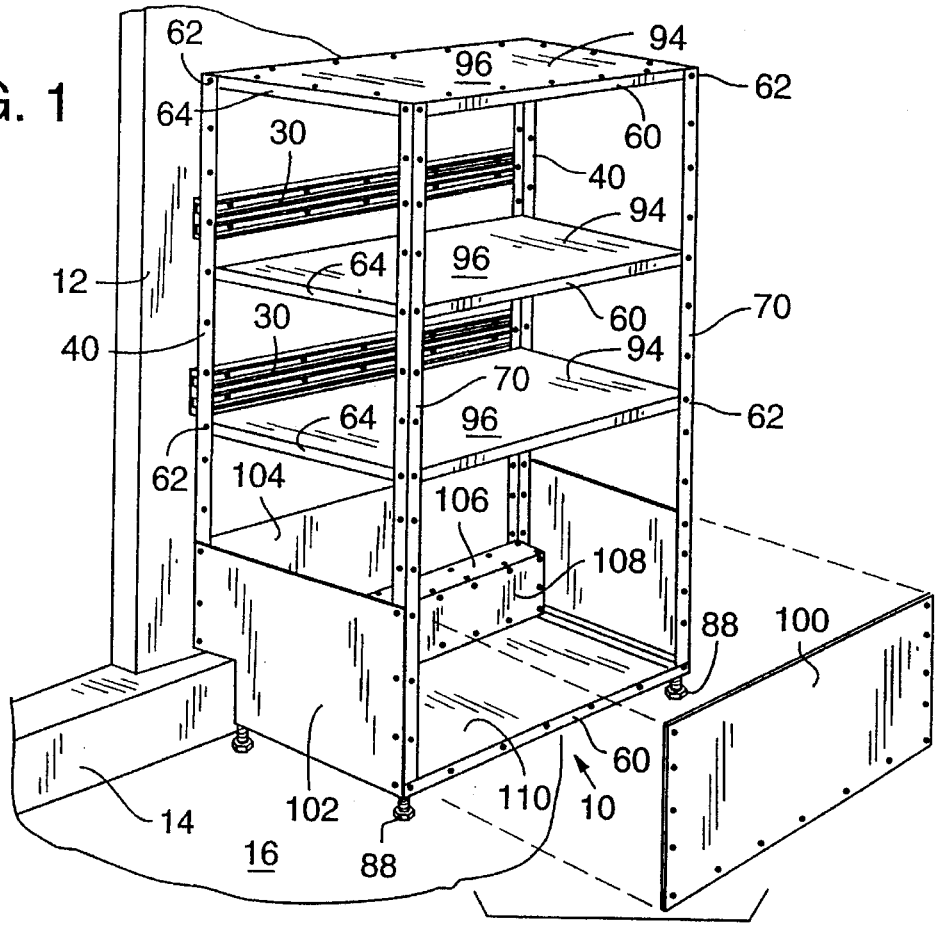
FIG. 1 is a view of an assembled storage unit of the present invention attached to a vertical wall and supported on a horizontal floor.

The present invention is a modular storage unit 10 that is easily assembled and securely installed. The storage unit 10 is arranged to be securely fastened to a vertical support member, such as a wall 12, and is further supported on a substantially horizontal surface, such as a floor 16. The components of the storage unit are all drilled and/or slotted to provide holes and slots for the insertion of conventional fasteners such as screws, nuts and bolts, and the like for ease of assembly. FIG. 1 illustrates a modular storage unit 10 that has been assembled, is supported on a floor 16 and is secured to a vertical wall 12. The front panel is shown removed for drawing clarity. The storage unit 10 in this embodiment has been secured to the vertical wall 12 that is resting on a footing 14. As shown the footing 14 is wider than the wall 12 and in effect forms an obstruction. The storage unit 10 is arranged to fit around the footing 14 (obstruction) so that the storage unit is supported on the floor 16 as well as being mounted against and secured to the wall 12.

Figure 2:
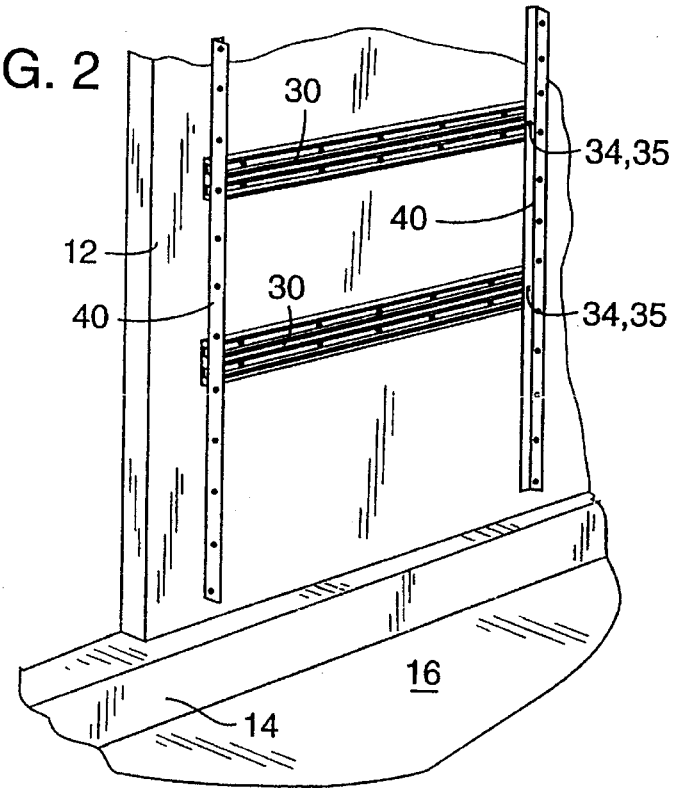
FIG. 2 is a view showing horizontal support rails mounted to a vertical wall.

FIG. 2 illustrates the manner of securing the framework of the storage unit 10 to the vertical wall 12. A pair of horizontal support rails 30 are mounted on the vertical wall 12 to serve as securement of the storage unit 10. The rails 30 are mounted at strategic heights above the floor 16 and are mounted level with one rail being mounted above the other and preferably with the ends of the rails being vertically aligned. The rails 30 are generally mounted to the studs 18 of the wall by conventional fasteners 31 such as screws, nails, or lag screws.

Figure 3:
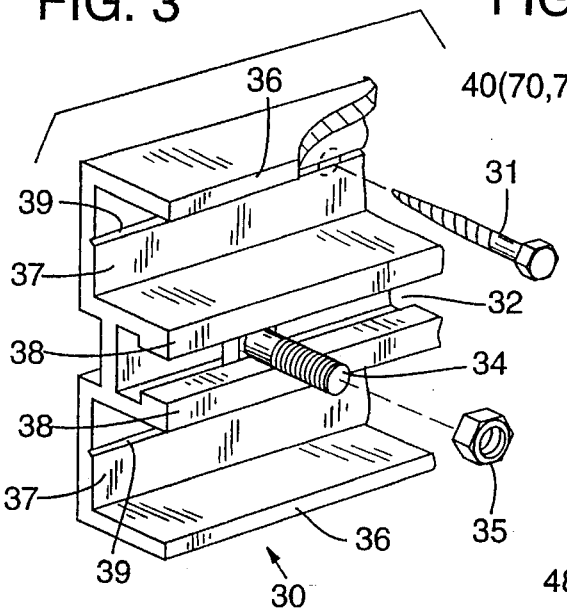
FIG. 3 is a view of the horizontal rails.

The rails 30 are further illustrated in FIG. 3 and have a defined opening, known as a bolt slot 32, arranged to receive fasteners 34, such as bolts, to facilitate attaching inner vertical support angles 40. The bolt slots 32 extend along the full length of the rail 30 so that the fasteners 34 may be positioned at any position along the length of the rail 30 to facilitate securely attaching the framework of the storage unit 10 in its desired position. The rail 30 has legs 36 that extend the same distance as the bolt slot legs 38 extend from the base portions 37. Fasteners 31 are driven through the base portions 37 and into the studs of the wall 12 to secure the rail 30 to the wall 12. A groove 39 is provided in each base portion 37 to facilitate starting the fastener 31.

Figure 8:
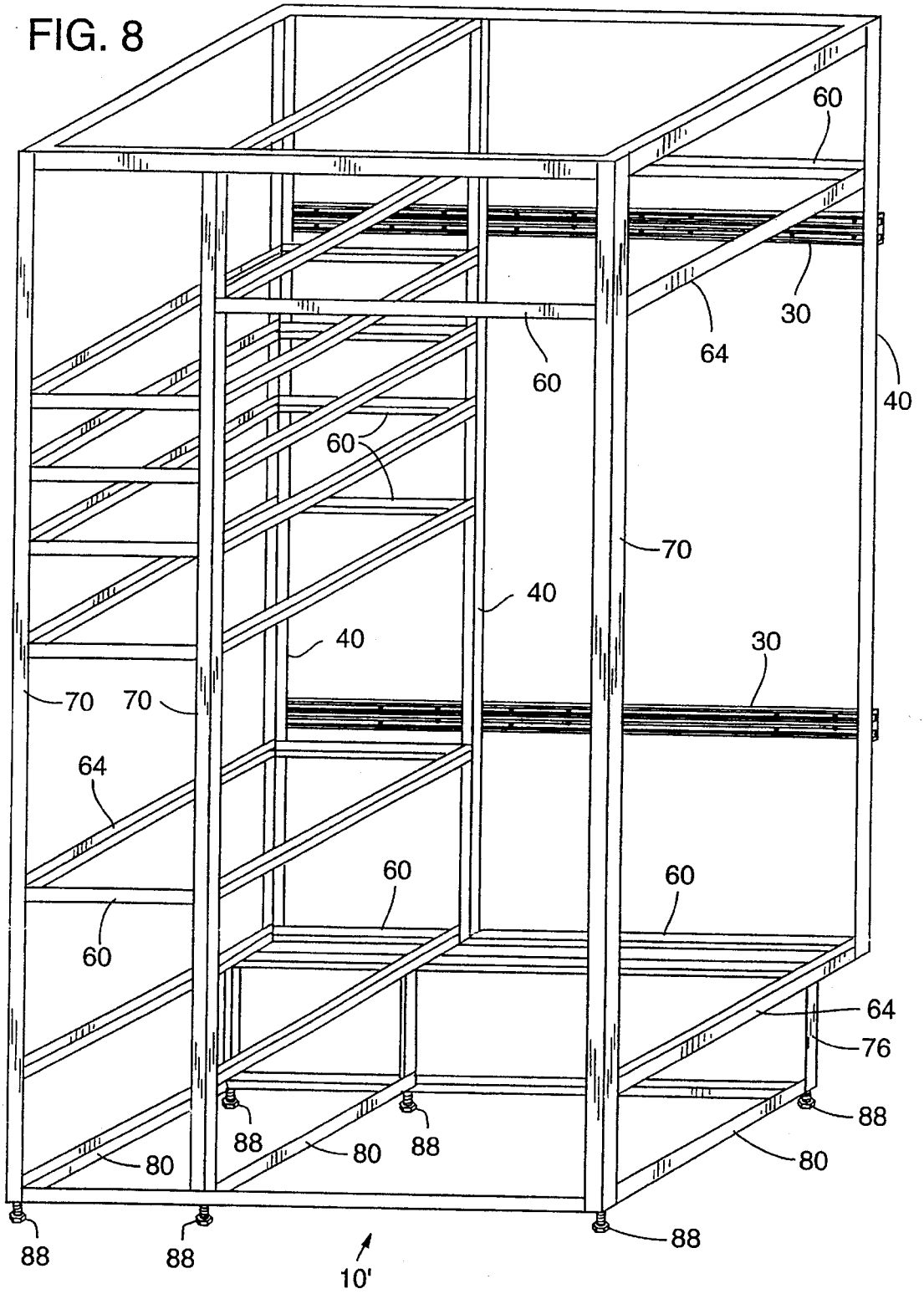

In this embodiment two vertical support angles 40 are mounted to the cross rails 30 (FIG. 2), however, the number of vertical angles utilized will depend on the configuration of the storage unit and as seen in the examples of the alternate embodiments of FIGS. 8 and 9, any number of vertical supporting angles 40 may be utilized. The vertical support angles 40 are mounted to the cross rails 30 by fasteners 34, such as bolts fitting in the bolt slot 32 and a nut 35. The vertical support angles 40 are pre-fabricated to provide holes or apertures to receiver fasteners 34. The holes and/or slots are strategically positioned to facilitate fastening the vertical angles 40 to the cross rails 30 at the proper position and also to facilitate mounting other members to the vertical support angles 40 as will be later detailed. This also ensures that the finished unit will be level.

Figure 4:
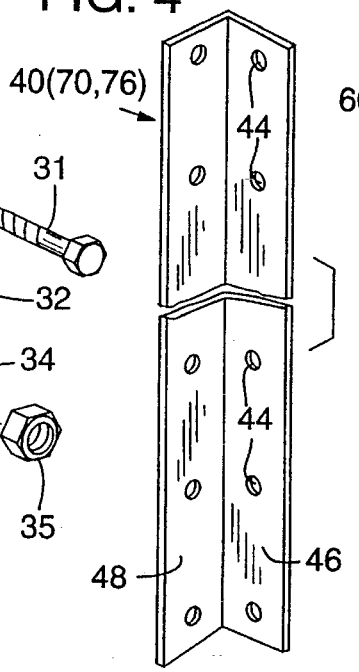
FIG. 4 is a view of the vertical support members of the storage unit of the present invention.

FIG. 4 illustrates the elongate vertical support angles utilized in the storage unit 10, the vertical support angles (legs) in this embodiment being designated by numerals 40, 70 and 76. The vertical angles will vary in length but all have holes and/or slots to facilitate mounting other members of the storage unit 10. As seen in the figure the angles are shaped members such as angle iron, steel angle, aluminum angle and the like which have apertures 44, such as holes and/or slots provided in each leg 46, 48 at strategic intervals along their length.

Figure 5:
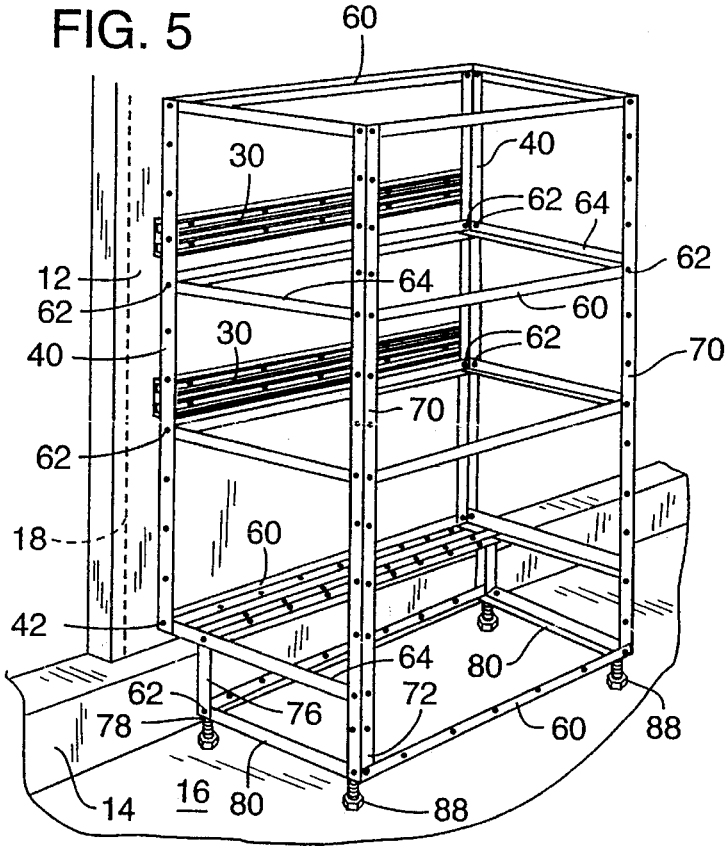
FIG. 5 is a view of an assembled frame of one embodiment of the present invention.

In this embodiment the wall 12 is supported on a footing 14 as shown in FIGS. 1 and 2. As seen the footing 14 is wider than the wall 12 and therefore extends a slight distance beyond the wall and inward onto the floor 16. Since the footing is wider than the wall 12, the vertical support angles 40 do not extend to the floor 16 but merely extend downward with an end 42 of the angle 40 in close proximity to the footing 14 as best seen in FIGS. 2 and 5. As previously mentioned the rails 30 are mounted at a strategic height above the floor 16. This height will place the lower end 42 of the angle 40 in close proximity to the footing 14 when the angle 40 is mounted to the rail 30 by a designated aperture 44. The horizontal rails 30 and the vertical support angles 40 in combination provide a foundation for mounting the balance of the framework and other components of the storage unit 10.

FIG. 5 illustrates the storage unit 10 being further assembled to the cross rails 30 and the vertical support angles 40. Lateral (horizontal) cross support members 60 extend between and are connected to the vertical angles 40 by fasteners 62, such as bolts and nuts. Side (horizontal) support members 64 extend outward from the vertical support angle at the same height position as the cross support members 60 and are secured to the vertical support angles 40 by additional fasteners 62. Outer vertical angles (legs) 70 are connected to the side support members 64 extending from the vertical angles 40. Additional lateral cross support members 60 extend between and are connected to the outer angles 70. A side support member 64 extends from the bottom 42 of each vertical support 40 to each outer angle 70.

Figure 6:
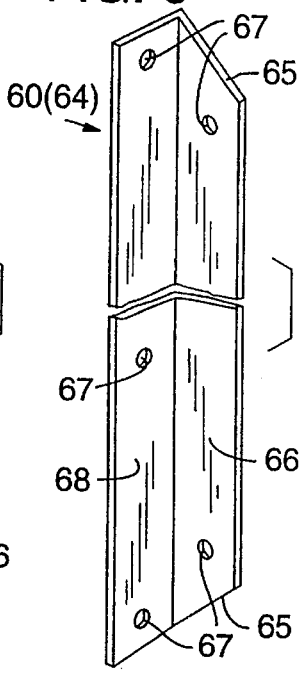
FIG. 6 is a view of horizontal support members of the storage unit of the present invention.
Figure 7:
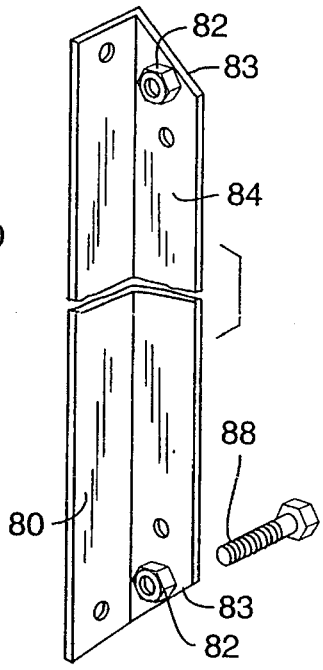
FIG. 7 is a view of a footer of the storage unit of the present invention; and, FIGS. 8 and 9 are views of other embodiments of the present invention.

The elongate horizontal support members 60, 64 are further illustrated in FIG. 6. The horizontal support members are preferably of angle made from industrial metals and have legs 66, 68 in which apertures 67, such as holes and/or slots, are provided. Each end 65 of leg 66 is formed at a 45 degree angle to facilitate joining two horizontal support members at a corner A short vertical angle (leg) 76 is connected to the side support member 64 extending from the bottom 42 of the vertical angle 40 with the vertical angle 76 being in close proximity to the footing 14 and therefore at a distance from the wall 12. A footer 80 is connected between the bottom 72 of the outer angle 70 and the bottom 78 of the short vertical angle 76. The footer 80 has threaded nuts 82 fixedly attached near its ends on leg 84 as shown in FIG. 7. The nuts 82 threadably receive adjusting bolts 88. The adjusting bolts 88 are utilized to adjust the height position of the outer angles (legs) 70 and the short vertical angles (legs) 76 so that the side support members 64 are level and the lateral support member 60 extending between the outer angles 70 is level. The adjusters (bolts) 88 will compensate for any variance in the surface of the floor 16. The ends 83 of leg 84 are formed at a 45 degree angle to facilitate joining of additional horizontal support members at a corner.

As seen in FIG. 1, in this embodiment panels 94 are installed on the mating lateral support members 60 and side support members 64. The panels 94, the lateral support members 60 and the side support members 64 in combination form shelves 96. The panels 94 are sized to fit the frame defined by the support members 60, 64 and have apertures that will line up with apertures in the legs of the support members 60, 64 to secure the panels in position by fasteners 62.

A bin is formed at the lower portion of the storage unit 10 by panels 102 being attached to the framework as shown in FIG. 1. The front panel 100 is shown removed to show the bottom and back panels. The panel 100 will be attached to the vertical legs 70 and the lower cross member 60 by fasteners 62. Side panels 102 are attached to the vertical legs 40, 70 and 76 by fasteners 62. A rear panel 104 is attached to the vertical legs 40 and to the cross member 60 joining the bottoms 42 of the leg 60 by fasteners 62. A top back panel 106 is attached to the members 60 extending between the bottom 42 of the legs 40 and the member 60 joining the top portion of legs 76 by fasteners 62. A back panel 108 is attached to the vertical legs 76 and the corresponding members 60 extending between the vertical legs 76 by fasteners 62. A bottom panel 110 is attached to the footers 80 and the cross members 60 extending between the footers 80. The panels are configured to conform to the geometry of the storage unit 10 and are slotted or notched as necessary. The bottom panel 110 for example will have notches or apertures provided to permit the adjustment of the bolts 88 to level the storage unit 10.

FIG. 8 illustrates another embodiment of a framework for a storage unit 10' that has been assembled utilizing the modular components previously described. It will be appreciated that the components will be of lengths to suit the requirements. The horizontal members 60, for example are provided in different lengths to connect adjacent legs 40 and adjacent legs 70. As seen, the frame utilizes horizontal rails 30 to which are attached vertical legs 40. The rails 30 are utilized to secure the framework to a vertical support member, such as a wall. In this embodiment, three legs 40 are utilized to form a portion of the framework. Horizontal members 64 extend outward from the vertical legs 40 and are attached to vertical legs 70 and as shown, each leg 40 has a corresponding leg 70. The frame of FIG. 8 is also arranged to accommodate an obstruction such as a footing 14 and has a short leg 76 that is positioned in close proximity to the footing 14 and is connected to the cross member 64 joining the lower end of the leg 40 to the outer leg 70. A footer 80 is connected between the bottom of the outer leg 70 and the inner leg 76. As shown, this frame has three footers 80 that have adjusters 88. The adjusters 88 will compensate for any slope or any variations in the floor 16. The components of the storage unit are arranged to provide for many configurations. As seen in the left side of the frame as viewed in the drawing, multiple storage compartments are provided by simply providing appropriate horizontal support members extending between adjacent legs 40, the adjacent legs 70 and additional horizontal members 64 extending between the inner legs 40 and the outer legs 70. Multiple storage compartments such as shelves may be formed by simply adding appropriate panels. The right side of the framework as viewed in the drawing is shown to provide a large compartment which may serve as a closet, for example, and with additional framework being provided above the closet area to facilitate receiving a suitable panel to form a shelf.

FIG. 9 illustrates another embodiment of a storage unit 10" that is securable to a vertical support member, such as a wall, and has adjusters 88 to compensate for any unevenness or slope of the horizontal supporting surface, such as a floor. As illustrated, shelves 96 may be provided in varying widths, at varying vertical spacings and may have vertical dividers provided at any desired interval. Additionally, other conventional components such as doors 120 may be added for closing off a compartment. Closet rods or hooks 122 may be provided for hanging garments, for example and other conventional components may be added to suit the requirements of a user.

FIGS. 8 and 9 are provided to show two variations of the storage unit 10 and it will be appreciated that the versatility afforded by the members of the framework having predrilled apertures such as holes and slots to facilitate fastening members together at different levels provides the capability of configuring a framework to suit most any requirement.

The panels mounted to the framework, whether it be to form shelves, bins or some other configuration define compartments that may be utilized to store material or articles.

Those skilled in the art will appreciate that variations and modifications may be made without departing from the true spirit and scope of the invention. The invention is therefore not to be limited to the embodiments described and illustrated but is to be determined from the appended claims.

I claim:

1. An easily assembled storage unit kit securable to a vertical support wall and supported on a non level floor surface, comprising:

a support rail having predetermined mounting positions and adapted for attachment to the vertical support wall in a level orientation;

a framework having mounting positions mated to the predetermined mounting positions of the support rail for mounting the framework to said support rail at said mated mounting positions and independent of said floor surface and achieving thereby level orientation of the framework; and an adjustable bottom support on said framework, said support adjustable as between the level framework and the non level floor surface and thereby adding to the wall support cooperative support for the framework by said non level floor surface.

2. An easily assembled storage unit kit as defined in claim 1, wherein said framework includes a panel mountable to said framework at said mountable positions and providing a storage compartment.

3. An easily assembled storage unit kit as defined in claim 1, wherein:

said support rail is configured to receive fasteners at said mounting positions;

fasteners mountable to said support rail at said mounting positions; and said framework configured at said mounting positions to receive said fasteners to mount said framework to said rail.

4. An easily assembled storage unit kit as defined in claim 3, wherein:

said support rail is configured to have a bolt slot extending substantially along the length of the rail; and said fasteners movable in said bolt slot for positioning said fasteners at said mounting positions.

5. A system for installing shelving secured to a wall and supported on a non level floor surface comprising:

a kit including a support rail, vertical support members, horizontal support members, panels, fasteners and adjustable support legs;

said rail having a predetermined mounting position and adapted to be mounted to the wall in a level orientation;

said vertical and horizontal support members having predetermined mounting positions for assembly by certain of the fasteners into a desired framework and the framework having cooperative mounting positions mountable at the predetermined mounting positions on the horizontally mounted rail in a level orientation end independent of said floor surface, and said panels mountable to the framework and said adjustable support legs mountable to said framework and extendable to said non level floor surface to cooperatively support said framework in a level condition on said wall and floor surface.

* * * * *